US008646516B2

(12) United States Patent
Abels et al.

(10) Patent No.: US 8,646,516 B2
(45) Date of Patent: Feb. 11, 2014

(54) ALTERNATING PLATE HEADERLESS HEAT EXCHANGERS

(75) Inventors: Kenneth Abels, Oakville (CA); W. Dennis Moss, Toronto (CA); Steven Lin, Mississauga (CA); Alan Wu, Kitchener (CA)

(73) Assignee: Pana Canada Corporation, Oakville, Ontario (CA)

( * ) Notice: Subject to any disclaimer, the term of this patent is extended or adjusted under 35 U.S.C. 154(b) by 1106 days.

(21) Appl. No.: 11/465,207

(22) Filed: Aug. 17, 2006

(65) Prior Publication Data

US 2008/0041570 A1 Feb. 21, 2008

(51) Int. Cl.
*F28F 3/06* (2006.01)

(52) U.S. Cl.
USPC ..... 165/166

(58) Field of Classification Search
USPC ..... 165/148, 152, 166, 173, DIG. 373, 165/DIG. 384, DIG. 387, DIG. 390, 165/DIG. 391, DIG. 392, DIG. 393
See application file for complete search history.

(56) References Cited

U.S. PATENT DOCUMENTS

| | | | | |
|---|---|---|---|---|
| 2,376,749 | A * | 5/1945 | Belaieff | 165/146 |
| 3,265,126 | A | 8/1966 | Donaldson | |
| 3,805,889 | A | 4/1974 | Coolidge | |
| 4,125,153 | A * | 11/1978 | Stoneberg | 165/166 |
| 4,343,355 | A * | 8/1982 | Goloff et al. | 165/166 |
| 4,348,604 | A * | 9/1982 | Thode | 310/59 |
| 4,350,201 | A | 9/1982 | Steineman | |
| 4,442,886 | A * | 4/1984 | Dinulescu | 165/76 |
| 4,527,622 | A * | 7/1985 | Weber | 165/166 |

(Continued)

FOREIGN PATENT DOCUMENTS

| | | |
|---|---|---|
| FR | 2 809 482 | 11/2001 |
| KR | 1064282 | 7/2001 |
| WO | WO 83/03663 | 10/1983 |

OTHER PUBLICATIONS

International Search Report and Preliminary Written Opinion dated Nov. 16, 2007 in respect of International Application No. PCT/CA2007/001422.

*Primary Examiner* — Teresa Walberg
(74) *Attorney, Agent, or Firm* — Ridout & Maybee LLP

(57) ABSTRACT

A plate and fin type heat exchanger has a heat exchanger core made from a plurality of stacked, alternating first and second heat exchange plates of a generally inverted, U-shaped cross-section. Each plate has a top wall, closed peripheral sidewalls and open ends, and the open ends of the first plates are oriented at 90° to the open ends of the second plates. The sidewalls of the plates have end portions, which in adjacent plates, are aligned to form corners of the heat exchanger core. Opposed U-shaped manifold bodies are provided having open ends and lateral walls joined in a fluid tight manner to the aligned plate sidewall end portions. End plates close off the open ends of the U-shaped bodies to form manifolds. The corners formed by the aligned plate sidewall end portions allow for an improved connection between the heat exchanger core and the U-shaped manifold bodies. This helps to ensure that a fluid tight seal is created between the heat exchanger core and the manifold bodies when the components are joined together.

20 Claims, 11 Drawing Sheets

(56) References Cited

U.S. PATENT DOCUMENTS

| | | | | |
|---|---|---|---|---|
| 5,681,538 | A * | 10/1997 | Sung et al. | 165/166 |
| 5,785,117 | A * | 7/1998 | Grinbergs | 165/166 |
| 6,311,768 | B1 | 11/2001 | Jamison et al. | |
| 6,332,495 | B1 | 12/2001 | Jamison et al. | |
| 6,446,713 | B1 | 9/2002 | Insaiaco | |
| 6,513,585 | B2 | 2/2003 | Brost et al. | |
| 6,516,874 | B2 | 2/2003 | Mathur et al. | |
| 6,530,424 | B2 | 3/2003 | Jamison et al. | |
| 6,668,916 | B2 | 12/2003 | Zobel et al. | |
| 2001/0037878 | A1 | 11/2001 | Brost et al. | |
| 2006/0011333 | A1 | 1/2006 | Emrich et al. | |

* cited by examiner

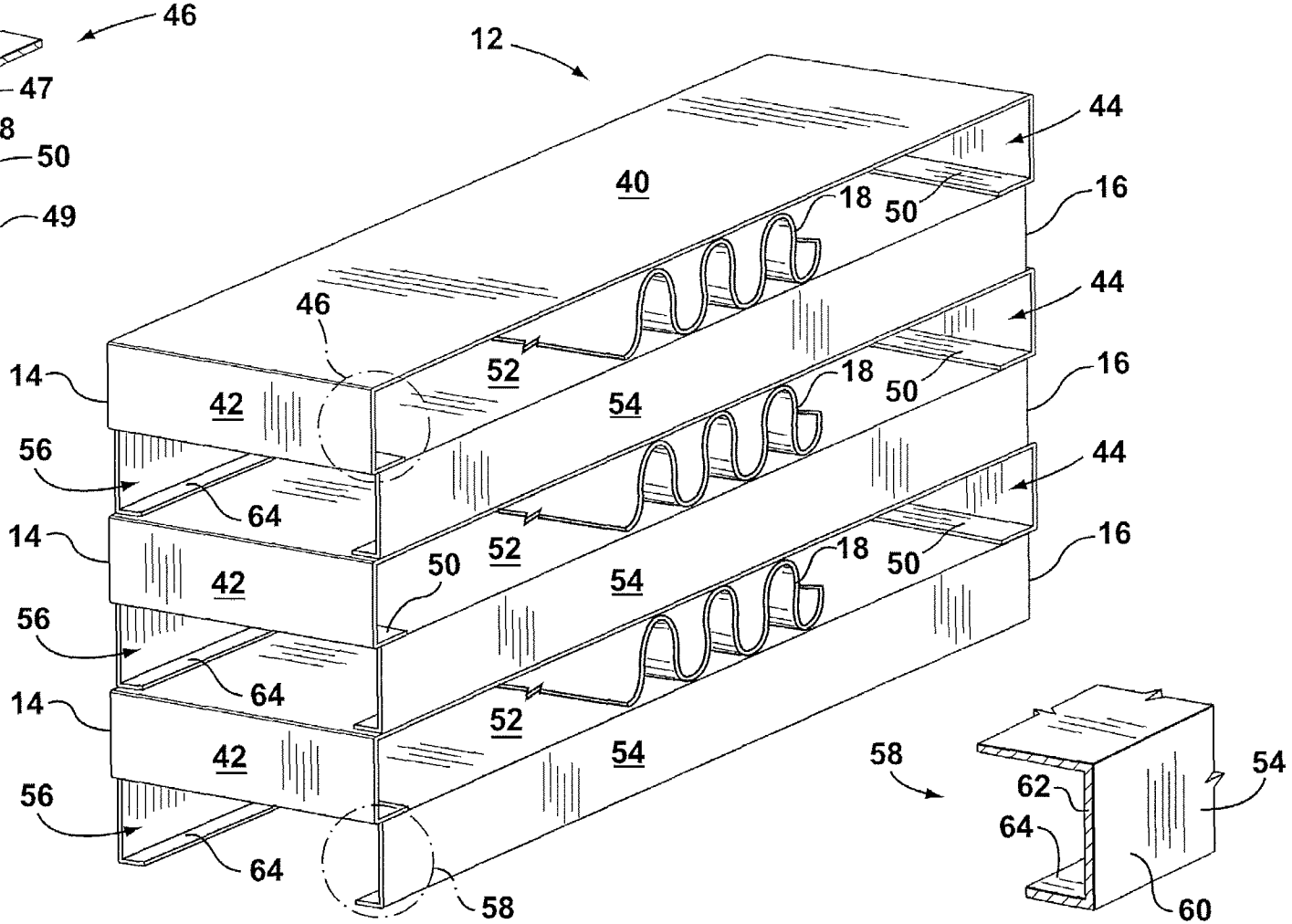
FIG. 2
FIG. 2B
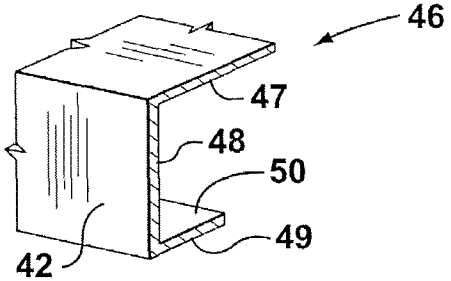
FIG. 2A

ALTERNATING PLATE HEADERLESS HEAT EXCHANGERS

FIELD OF THE INVENTION

The invention relates to heat exchangers, and in particular, to plate and fin type heat exchangers of the type commonly used in vehicles.

BACKGROUND OF THE INVENTION

In the past, engine coolant heat exchangers, such as radiators, have been made by providing a plurality of parallel, spaced-apart flat tubes with cooling fins located therebetween to form a core. Opposed ends of the tubes pass through openings formed in manifolds or headers located on each side of the core at the respective ends of the tubes. A difficulty with this type of construction is that the tube to header joints are difficult to fabricate and prone to leakage. As well, there is a tendency for the tube to header joints to fail as a result of stresses caused by thermal cycling. Therefore, this type of construction presents problems with both the manufacture and operation of the heat exchanger.

A method of overcoming these difficulties is shown in U.S. Pat. No. 3,265,126 which issued to D. M. Donaldson. In this patent, manifolds are provided with a continuous longitudinal opening, and the tubes are formed with specifically shaped ends to fit into this continuous opening, thus simplifying the assembly and reducing the leakage problem. A difficulty with the Donaldson structure, however, is that the shape of the various components is quite complex resulting in high tooling costs.

In order to facilitate the design of heat exchanger components and thereby reduce manufacturing costs, various improvements to headerless heat exchangers have been made. For instance, U.S. Pat. No. 6,332,495 which issued to Jamison et al. discloses a clip-on manifold heat exchanger formed from a plurality of stacked plate pairs having raised peripheral edge portions to define flow channels inside the plate pairs. The plates of the plate pairs are formed with offset, diverging end flanges that space the plate pairs apart. A U-shaped channel envelopes the plate end flanges to form part of a manifold at each end of the plate pairs, and end caps or plates close the open ends of the U-shaped channels to complete the manifolds. The components are typically joined together by brazing or any other suitable technique.

U.S. Pat. No. 6,513,585 which issued to Brost et al. discloses a headerless vehicle radiator formed of tubes having end walls which are bifurcated for a short distance from the ends of the tubes and having one or both of the sidewalls in the bifurcated segment of the tube formed outwardly and adapted to contact and be joined in a fluid tight manner with the sidewall of an adjacent tube in the radiator core. A collecting tank (or manifold) has walls extending partially over the radiator core to a distance beyond the bifurcation of the sidewalls, the collecting tank walls being joined to the end walls of the tubes in a fluid tight manner. Once again, the various components of the heat exchanger (or radiator) are typically joined together by brazing or any other suitable technique.

In both the Jamison et al. and Brost et al. heat exchangers, the performance of the heat exchanger depends in part on the effectiveness of the joint achieved between the plate pairs and the walls of the U-shaped channels or manifolds. Due to the thicknesses of the materials used in creating the components of these types of heat exchangers, it can be difficult to achieve an effective seal or bond between the plate pairs.

SUMMARY OF THE INVENTION

In the present invention, the plates in the plate pairs are oriented at 90 degrees to one another, so that end portions of the plate sidewalls provide more surface area to better seal with the manifold walls.

According to the invention, there is provided a heat exchanger comprising a plurality of stacked, alternating first and second heat exchange plates having an inverted U-shaped cross-section. The plates have closed peripheral sidewalls and open ends, and the open ends of the first plates are oriented at 90 degrees to the open ends of the second plates. The sidewalls of the first and second plates have end portions which, in adjacent plates, are aligned to form corners of the heat exchanger. Opposed U-shaped bodies are provided having open ends and lateral walls joined in a fluid tight manner to the aligned first and second plate sidewall end portions. End plates close the open ends of the U-shaped bodies to form manifolds for the flow of fluid through the plate open ends in the second plates. The manifolds also include inlet and outlet openings for the flow of fluid into and out of the heat exchanger.

BRIEF DESCRIPTION OF THE DRAWINGS

Preferred embodiments of the invention will now be described, by way of example, with reference to the accompanying drawings, in which:

FIG. 2 is a perspective view of a heat exchanger core according to a preferred embodiment of the invention;

FIGS. 2A and 2B are detail views of the respective heat exchanger plate end portions identified by chain-dotted lines 46 and 58 in FIG. 2;

DETAILED DESCRIPTION OF THE PREFERRED EMBODIMENTS

Figure 1:
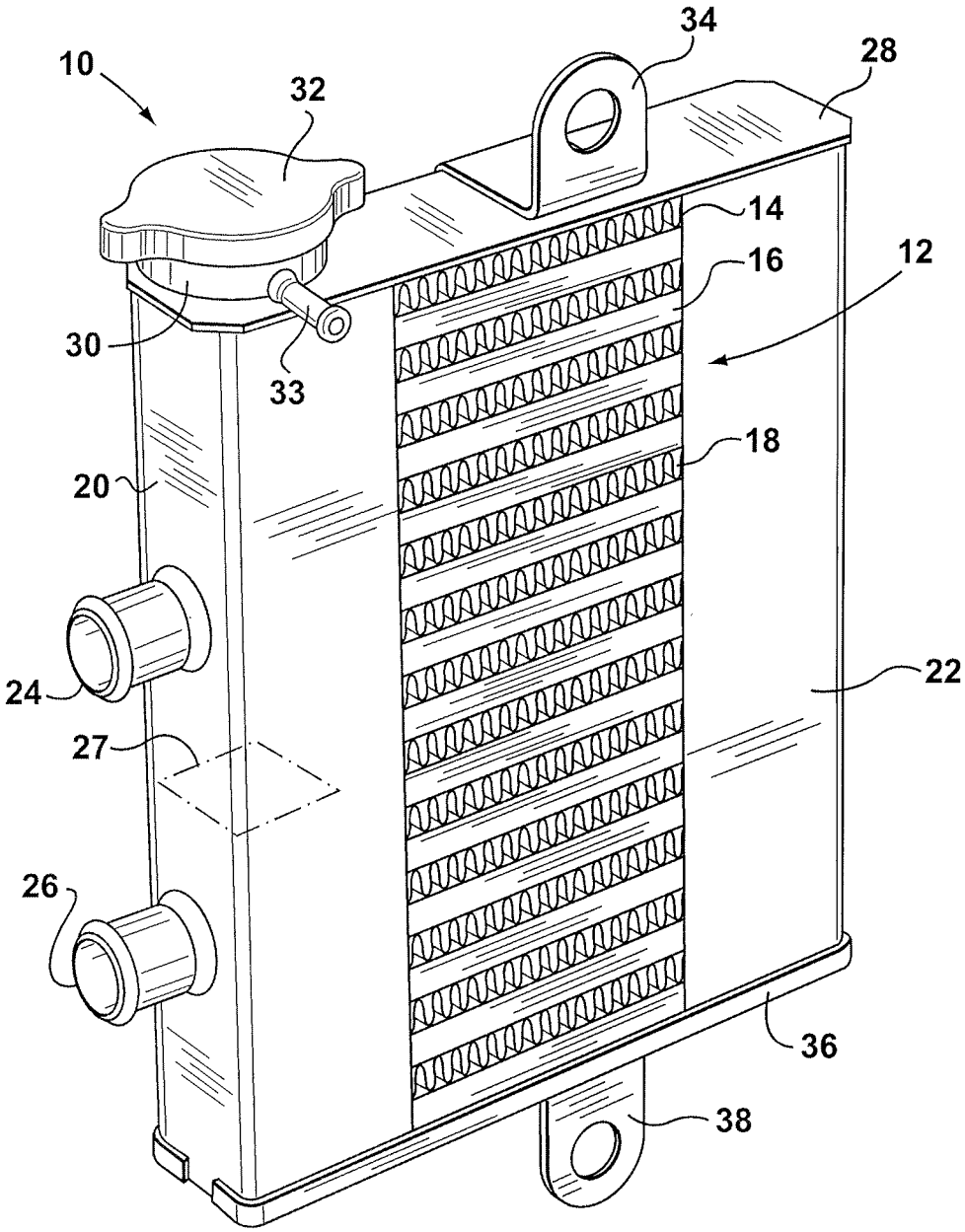
FIG. 1 is a top, left perspective view of a preferred embodiment of a heat exchanger made in accordance with the present invention.

Referring to the drawings, there is shown in FIG. 1 a heat exchanger 10 according to an embodiment of the present invention. For the purpose of example, heat exchanger 10 is in the form of a radiator for cooling the coolant of an internal combustion engine, such as is typically found in an automotive vehicle. However, the heat exchanger of the present invention can be used for various applications such as oil coolers or charge-air applications which operate using various types of fluids.

Heat exchanger 10 includes a core 12 formed of a plurality of stacked, alternating first and second heat exchange plates 14, 16 with cooling fins 18 located therebetween. Cooling fins 18 are the usual type of corrugated cooling fins having transverse undulations or louvres formed therein to increase heat transfer. However, any type of cooling fin could be used in the present invention or even no cooling fin at all, if desired.

Heat exchanger 10 has a pair of manifold members 20, 22 located at the respective ends of the heat exchanger core 12. Inlet and outlet nipples or fittings 24, 26 are mounted in one of the manifold members 20, 22 for the flow of coolant into and out of the heat exchanger 10. While the inlet and outlet fittings 24, 26 are shown in FIG. 1 as being mounted in the same manifold member with a baffle member 27 therebetween, it will be understood that the inlet and outlet fittings 24, 26 can be mounted in separate manifold members, without the use of a baffle, depending on the specific configuration of the heat exchanger 10.

A top end plate 28 closes the upper ends of manifold members 20, 22 and provides a location for a filler cap fitting 30 and filler cap 32, as well as a mounting bracket 34 used for mounting the heat exchanger 10 in a desired location. The filler cap fitting 30 also includes an overflow or pressure relief outlet 33. A bottom end plate 36 is also provided for closing the lower ends of manifold members 20, 22. Bottom end plate 36 also provides a location for the attachment of another mounting bracket 38 for mounting heat exchanger 10 in the desired location. It will be understood that although the filler cap fitting 30 and filler cap 32 have been shown as being mounted in the top end plate 28, these components could in fact be mounted in or attached to either manifold member 20, 22 as opposed to the top end plate 28.

FIG. 2 illustrates a preferred embodiment of the heat exchanger core 12. As mentioned above, heat exchanger core 12 is formed from a plurality of stacked, alternating first and second heat exchange plates 14, 16. The first heat exchange plates 14 are formed of inverted, generally U-shaped channel members each having a top wall 40, two downwardly depending closed peripheral side walls 42, and open ends 44. The closed peripheral side walls 42 also include inwardly bent flange portions 50 for resting on the adjacent second heat exchange plate 16 when the first and second plates 14, 16 are alternatingly stacked together. As well, the first heat exchange plates 14 have end portions 46 (see FIG. 2A) which include the end edges 47 of a portion of the top wall 40, the end edges 48 of the closed peripheral side walls 42, and the end edges 49 of inwardly bent flange portion 50.

The second heat exchange plates 16 are also formed of inverted, generally U-shaped channel members each having a top wall 52, two downwardly depending closed peripheral sidewalls 54, and open ends 56. The closed peripheral side walls 54 also include inwardly bent flange portions 64 for resting on the adjacent first heat exchange plate 14 when the first and second plates 14, 16 are stacked together in their alternating relationship. As well, the second heat exchange plates 16 have end portions 58 (see FIG. 2B) which include planar regions 60 of the side walls 54 adjacent the end edges 62 thereof.

The heat exchanger core 12 is assembled so that as the first and second heat exchange plates 14, 16 are stacked together the open ends 44 of the first plates 14 are oriented at 90 degrees to the open ends 56 of the second plates 16. Accordingly, the end portions 46 of the first plates 14 are aligned with the end portions 58 of the second plates 16 to form corners of the heat exchanger core 12. Flange portions 50 of the first plates 14 rest on the top wall 52 of the adjacent second plate 16 along the corresponding open end 56 thereof. Similarly, the flange portions 64 of the second plates 16 rest on the top wall 40 of the adjacent first plate 14 along the corresponding open end 44 thereof. Flange portions 50, 64 allow for an appropriate amount of surface contact between the respective first and second plates 14, 16 to create a good seal between the components when the first and second plates 14, 16 are joined together by brazing (or by any other suitable method).

The stacking of the first and second plates 14, 16 creates a first set of flow channels between the open ends 44 of the first plates 14 for the flow of a first fluid therethrough. Similarly, a second set of flow channels is created between the open ends 56 of the second heat exchange plates 16 for the flow of a second fluid therethrough. As the open ends 44, 56 of the first and second plates 14, 16 are oriented at 90 degrees to one another, the flow of the first fluid is transverse to the flow of the second fluid through the heat exchanger core 12. Cooling fins 18 are located in the first set of flow channels created between the first and second plates 14, 16 to help increase heat exchange between the first and second fluids. When used as the radiator of an internal combustion engine, the first fluid is usually air and the second fluid is coolant.

Figure 3:
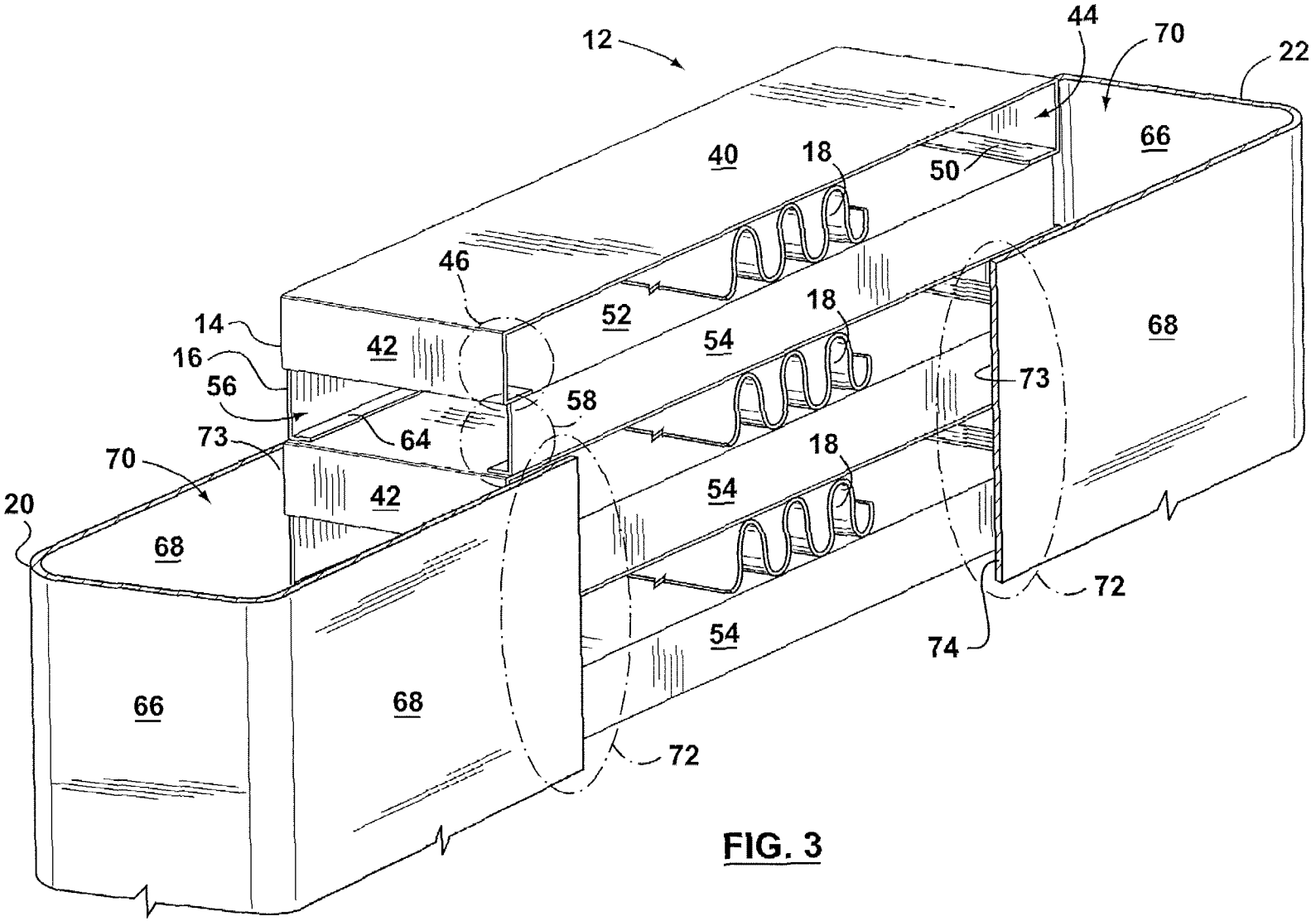
FIG. 3 is a perspective view of a partially assembled heat exchanger utilizing the heat exchanger core of FIG. 2.

Referring now to FIG. 3, manifold members 20, 22 are located at the respective ends of the heat exchanger core 12. Manifold members 20, 22 are each formed of a generally U-shaped body having a rear wall 66, a pair of lateral walls 68, and open upper and lower ends 70. The manifold members 20, 22 are sized so as to fit snugly around the heat exchanger core 12. The lateral walls 68 have end portions 72 which include the planar inner end surfaces 73 of the lateral walls 68 proximal to the end edges 74 thereof. With the manifold members 20, 22 in place on the heat exchanger core 12, the end portions 72 are adapted to overlap and engage the aligned end portions 46, 58 of the first and second heat exchange plates 14, 16 in a fluid tight manner. Therefore, the manifold members 20, 22, and in particular, the inner end surfaces 73, contact both the end edges 47, 48, 49 of the first heat exchange plates 14, and the planar regions 60 of the second heat exchange plates 16. Accordingly, manifold members 20, 22 create butt joints with the first heat exchange plates 14 and lap joints with the second heat exchange plates 16. The open upper and lower ends 70 of manifold members 20, 22 are closed by top and bottom end plates 28, 36 to form the heat exchanger 10 as described above in connection with FIG. 1.

Figure 4:
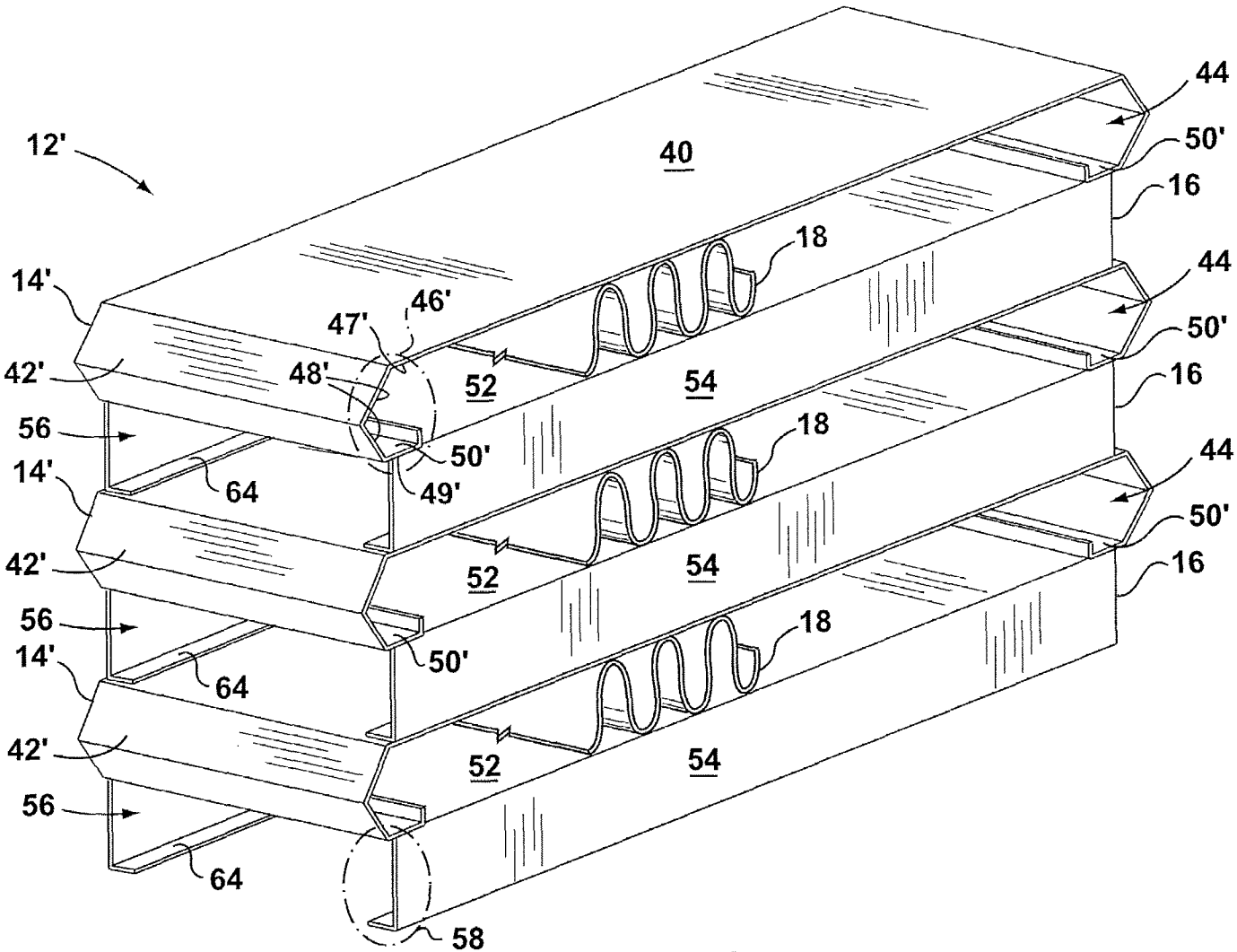
FIG. 4 is a perspective view of a heat exchanger core according to another embodiment of the invention.

FIG. 4 illustrates a variation to the heat exchanger core 12 shown in FIGS. 2 and 3, where similar reference numerals have been used to identify similar features. In this embodiment, heat exchanger core 12' is comprised of an alternating stack of modified first heat exchange plates 14' and second heat exchange plates 16. First heat exchange plates 14' are also formed of inverted, generally U-shaped bodies with top wall 40, two downwardly depending closed peripheral side walls 42' and open ends 44. However, closed peripheral side walls 42' have been modified to have a tapered or triangular profile. Therefore, the end portions 46' of first plates 14' include the shaped end edges 48' of the modified side walls 42' as well as the end edges 47', 49' of a portion of the top wall 40 and flange portion 50'.

The shaping of the side walls 42' forms a sloping or funnel-like structure surrounding the open ends 56 of the second heat exchange plates 16, when the first and second plates 14', 16 are stacked in their alternating relationship. The funnel-like structure created by the triangular profile of the side walls 42' helps to minimize entrance pressures losses into the second set of flow channels in the heat exchanger core 12' formed by the second heat exchange plates 16.

Manifold members 20, 22 are positioned on the respective ends of heat exchanger core 12' in a similar manner as described in connection with the embodiment shown in FIG. 2. Accordingly, manifold members 20, 22 create butt joints and lap joints with the respective end portions 46', 58 of the first and second heat exchange plates 14', 16.

Figure 5:
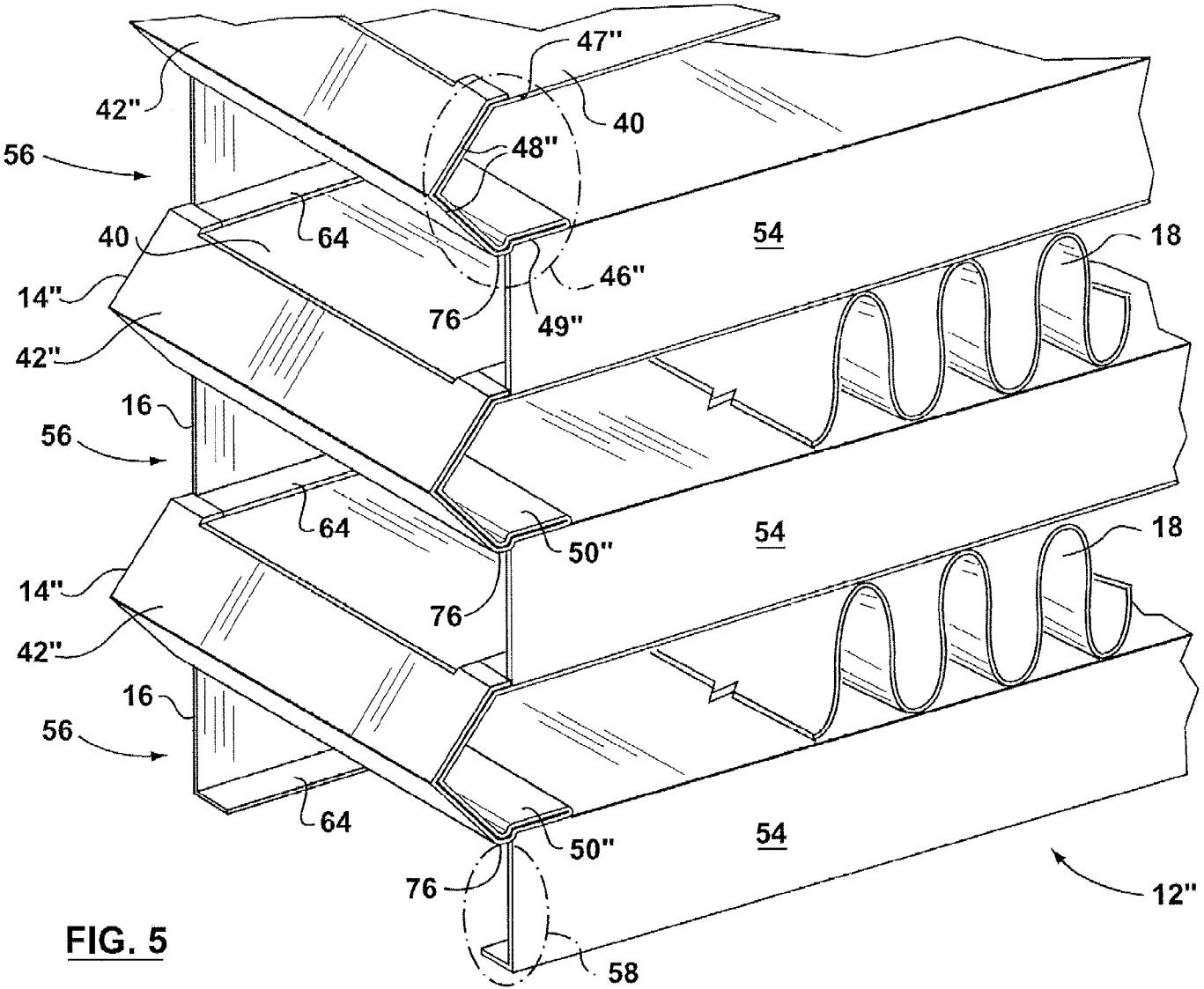
FIG. 5 is a partial perspective view of a heat exchanger core according to a further embodiment of the invention.

FIG. 5 shows another embodiment of the heat exchanger core 12" of the present invention, which includes additional features to help facilitate the assembly of the heat exchanger core 12". Once again, similar reference numerals have been used to identify similar features. In this embodiment, the core 12" is formed of an alternating stack of modified first exchange plates 14" and the standard second heat exchange plates 16. First heat exchange plates 14" are similar to those described in connection with the embodiment shown in FIG. 4; however, in this embodiment, the closed peripheral side walls 42" are double-backed on themselves. Therefore, side walls 42" of the first heat exchange plates 14" are of at least twice the thickness of the side walls 42, 42' shown in the previously described embodiments. The added thickness to the side walls 42" not only increases the strength of the side walls, but the double-wall thickness also increases the surface area of end edges 48", 49" of end portions 46" of the first heat exchange plates 14".

In this embodiment, the side walls 42" of the first plates 14" further include offset portions 76 that precede and project slightly beyond the base of flange portions 50". Offset portions 76 help position first plates 14" with respect to the second plates 16 as they are stacked in their alternating relationship. As first plates 14" are positioned on top of second plates 16, offset portions 76 abut the end edge of top wall 52, thereby aligning the first plate 14" with respect to the associated second plate 16. Accordingly, the first and second heat exchange plates 14", 16 are considered to be "self-fixturing". While the "self-fixturing" features of the heat exchange plates have only been described in connection with the embodiment shown in FIG. 5, it will be understood that similar features can be incorporated into the other embodiments described herein.

Once again, manifold members 20, 22 (not shown) are positioned on the respective ends of the heat exchanger core 12" in a similar manner as described in connection with the embodiment shown in FIG. 2. Therefore, manifold members 20, 22 create butt joints and lap joints with the respective end portions 46", 58 of the first and second heat exchange plates 14", 16. Since the end edges 48" of side walls 42" are twice as thick as the side wall end edges shown in the previously described embodiments, it is possible to achieve a more robust butt joint when the components are joined together, for example, by brazing. This helps to ensure that a fluid tight seal is created between the heat exchanger core 12' and the manifold members 20, 22.

Figures 6, 6A, 6B:
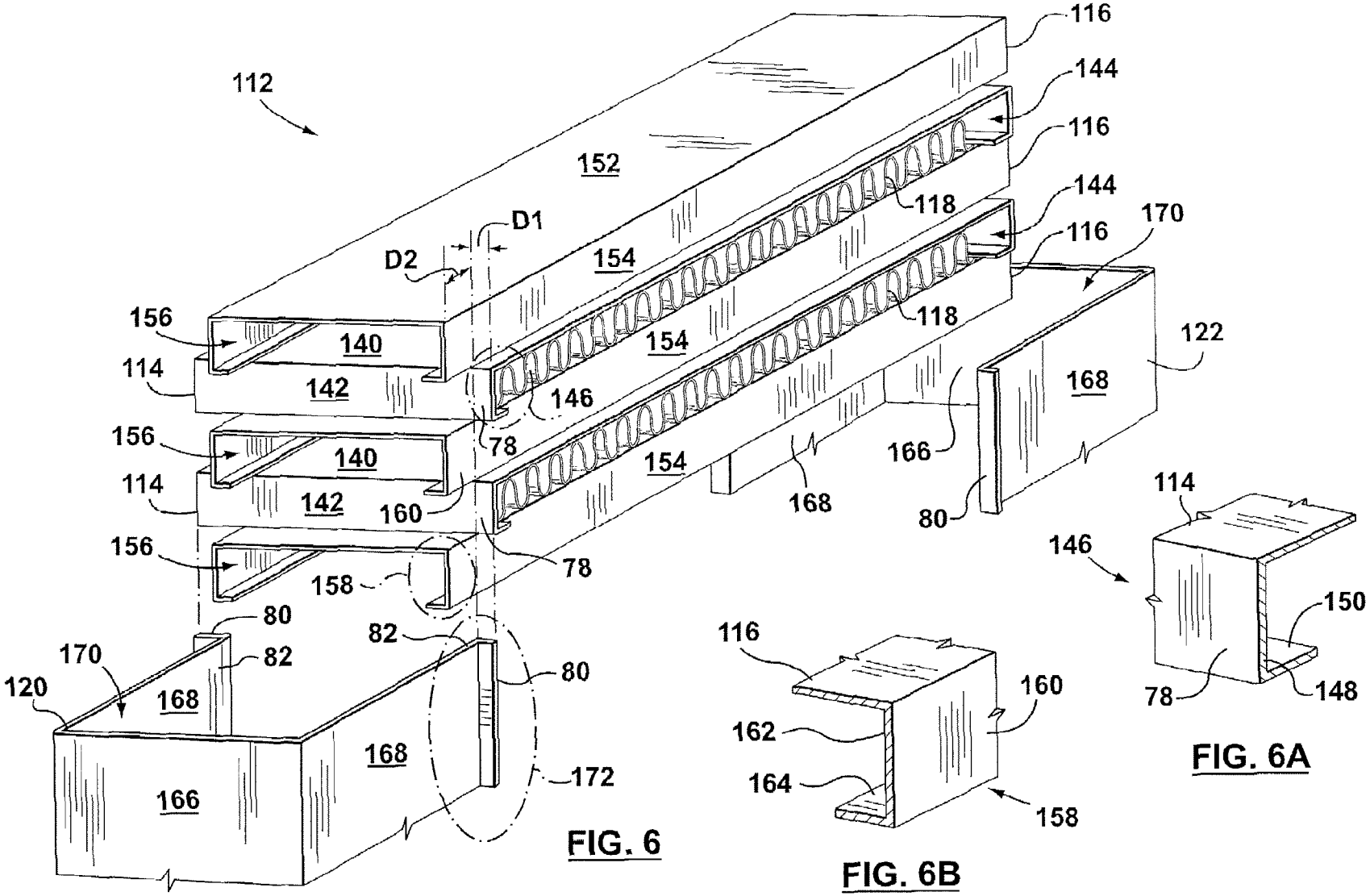
FIG. 6 is a perspective view of a partially assembled heat exchanger showing another embodiment of the present invention.
FIGS. 6A and 6B are detail views of the heat exchanger plate end portions identified by chain-dotted lines 146 and 158 in FIG. 6.

Referring now to FIG. 6, there is shown another embodiment of a heat exchanger according to the present invention. Similar reference numerals increased by a factor of one hundred have been used to identify similar features. In this embodiment, heat exchanger core 112 is formed of a plurality of stacked, alternating first and second heat exchanger plates 114, 116. As described in connection with the embodiment shown in FIG. 2, first heat exchange plates 114 are formed of inverted, generally U-shaped channel members each having a top wall 140, two downwardly depending closed peripheral side walls 142, and open ends 144. The closed peripheral side walls 142 have end portions 146 which, in this case, include planar regions 78 on the surface of side walls 142 proximal to the end edges 148 thereof (See FIG. 6A). The closed peripheral side walls 142 also include inwardly bent flange portions 150 for resting on the adjacent second heat exchange plate 116 when the first and second plates 114, 116 are alternatingly stacked together.

The second heat exchange plates 116 are also formed of inverted, generally U-shaped channel members each having a top wall 152, two downwardly depending closed peripheral sidewalls 154, and open ends 156. The closed peripheral side walls 154 have end portions 158 which, as described in connection with FIG. 2, include planar regions 160 of the side walls 154 adjacent the end edges 162 thereof (See FIG. 6B). The closed peripheral side walls 154 also include inwardly bent flange portions 164 for resting on the adjacent first heat exchange plate 114 when the first and second plates 114, 116 are stacked together in their alternating relationship.

To form the core 112, the first and second heat exchange plates 114, 116 are alternatingly stacked together so that the open ends 144 of the first plates 114 are at 90 degrees to the open ends of the second plates 116. However, in this embodiment, the first plates 114 are designed so as to be wider than second plates 116, and second plates 116 are designed so as to be longer than first plates 114. Accordingly, end portions 146 of the first plates 114 overhang the side walls 152 of the second plates 116 by a distance D1, and end portions 158 of the second plates overhang the side walls 142 of the first plates 114 by a distance D2. Therefore, when the first and second plates 114, 116 are stacked in their alternating relationship, end portions 146 and 158 align in such a way so as to form corners of the heat exchanger core 120 defined by planar regions 78 and 160. As shown in FIG. 6, the corners formed by planar regions 78, 160 of the first and second heat exchange plates 114, 116 are substantially 90 degree recessed corners for receiving corresponding ends of the associated manifold members. Once again, cooling fins 118 are positioned in the first set of flow channels created between the open ends 144 of the first heat exchanger plates 114 to increase heat exchange through the core 112.

To form the heat exchanger, manifold members 120, 122, are positioned at respective ends of the heat exchanger core 112. Manifold members 120, 122 are each formed of a generally U-shaped body having a rear wall 166, a pair of lateral walls 168, and open upper and lower ends 170. The manifold members 120, 122 are sized so as to fit snugly around the heat exchanger core 112 and the lateral walls 168 have end portions 172 which correspond to and are adapted to engage the corners of the core 112.

In the embodiment shown in FIG. 6, end portions 172 of the lateral walls 168 include an outwardly bent first end surface 80, and a second end surface 82 which includes a planar region of the inner surface of the lateral walls 168. The first end surface 80 corresponds to and engages with planar regions 78 on the first plates 114, and the second end surface 82 corresponds to and engages with planar regions 160 on the second plates 116 (See FIG. 7). Therefore, in this embodiment, manifold members 120, 122 create lap joints with both the first and second heat exchange plates 114, 116, which further improves the fluid tight seal created between the manifold members 120, 122 and the heat exchanger core 112 when the components are joined together, such as by brazing. The open upper and lower ends 170 of manifold members 20, 22 are closed by top and bottom end plates to form the heat exchanger as described above in connection with FIG. 1 and understood by those skilled in the art.

Figures 7, 9:
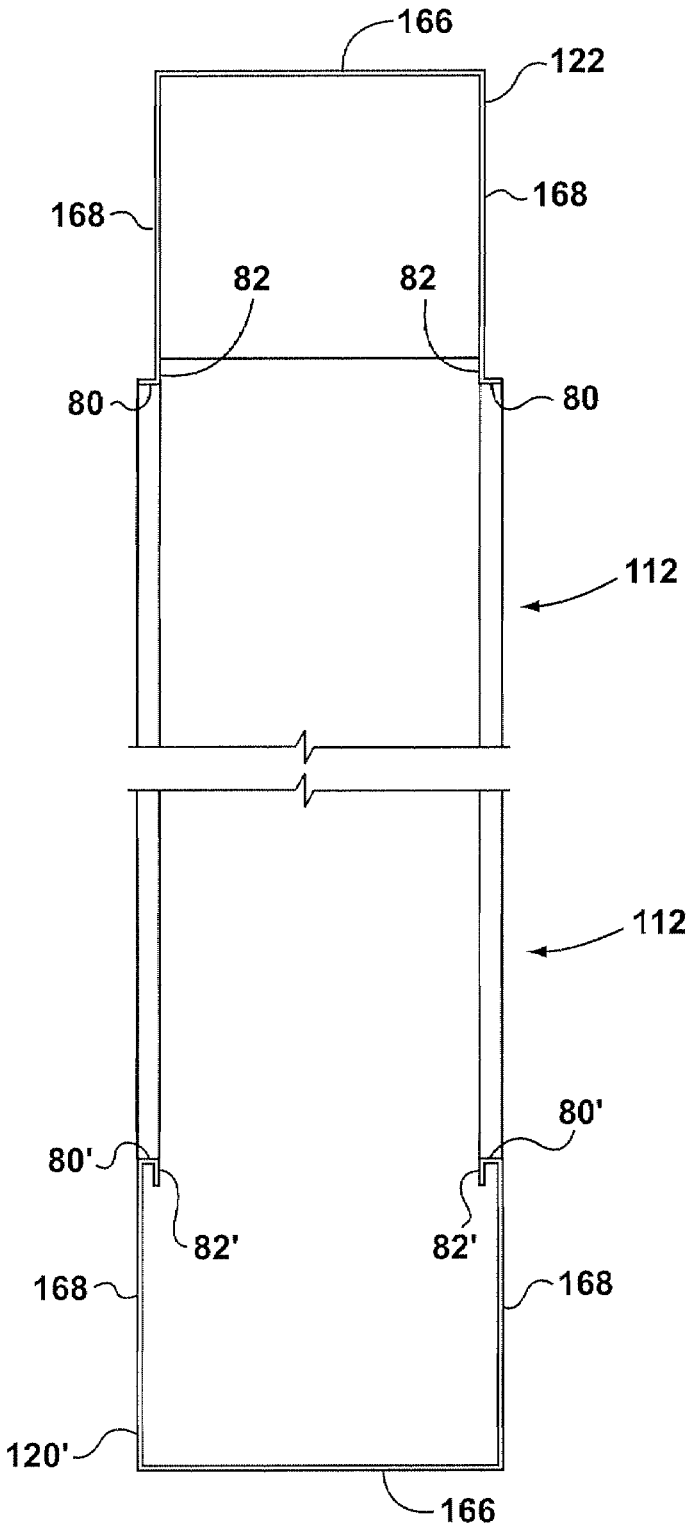
FIG. 7 is a partial top view of the partially assembled heat exchanger shown in FIG. 6.
FIG. 9 is a partial top view of the partially assembled heat exchanger shown in FIG. 8.
Figures 8, 8A:
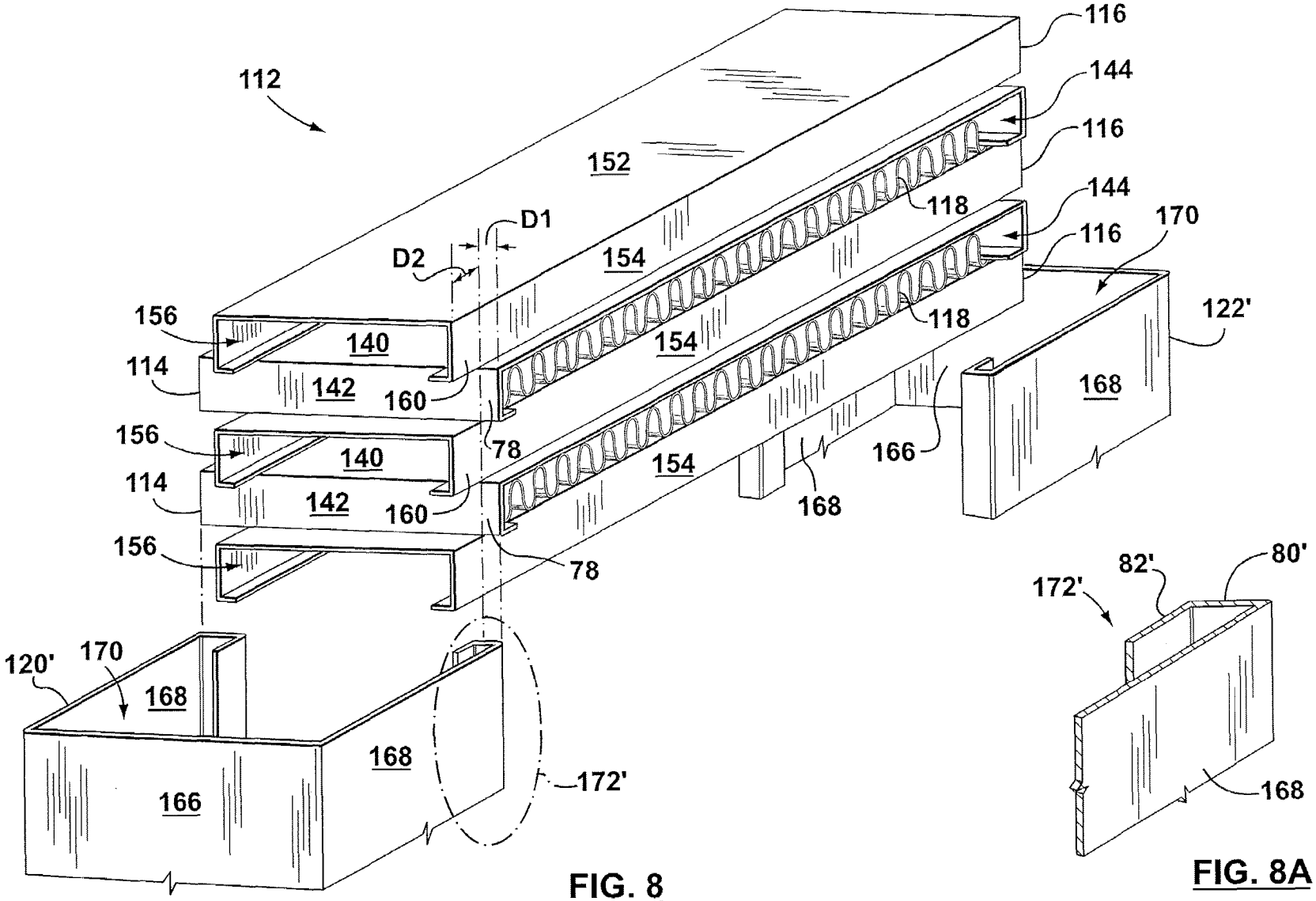
FIG. 8 is a perspective view of a partially assembled heat exchanger showing yet another embodiment of the present invention.
FIG. 8A is a detail view of the manifold member end portion identified by chain-dotted line 172' in FIG. 8.

FIG. 8 illustrates a variation of the embodiment shown in FIGS. 6 and 7. The heat exchanger core 112 is the same as described in connection with FIG. 6; however, manifold members 120', 122' have been modified. In this embodiment, the end portions 172' are formed of inwardly bent portions of the lateral walls 168 that have been bent at a first right angle to create the first end surface 80', which extends generally perpendicular to lateral walls 168, and bent at a second right angle to create the second end surface 82', which extends into the opening of the manifold member parallel to lateral walls 168 (See FIG. 8A). First end surface 80' corresponds to and mates with planar regions 78 on the first heat exchange plates 114, and second end surface 82' corresponds to and mates with planar regions 160 on the second heat exchange plates 116 (See FIG. 9). Therefore, in this embodiment, manifold members 120', 122' also create lap joints with both the first and second heat exchange plates 114, 116 thereby ensuring a more robust seal between the components when they are joined together. The open upper and lower ends 170 of manifold members 120', 122' are closed by top and bottom end plates to form the heat exchanger as described above in connection with FIG. 1 and understood by those skilled in the art.

Figure 10:
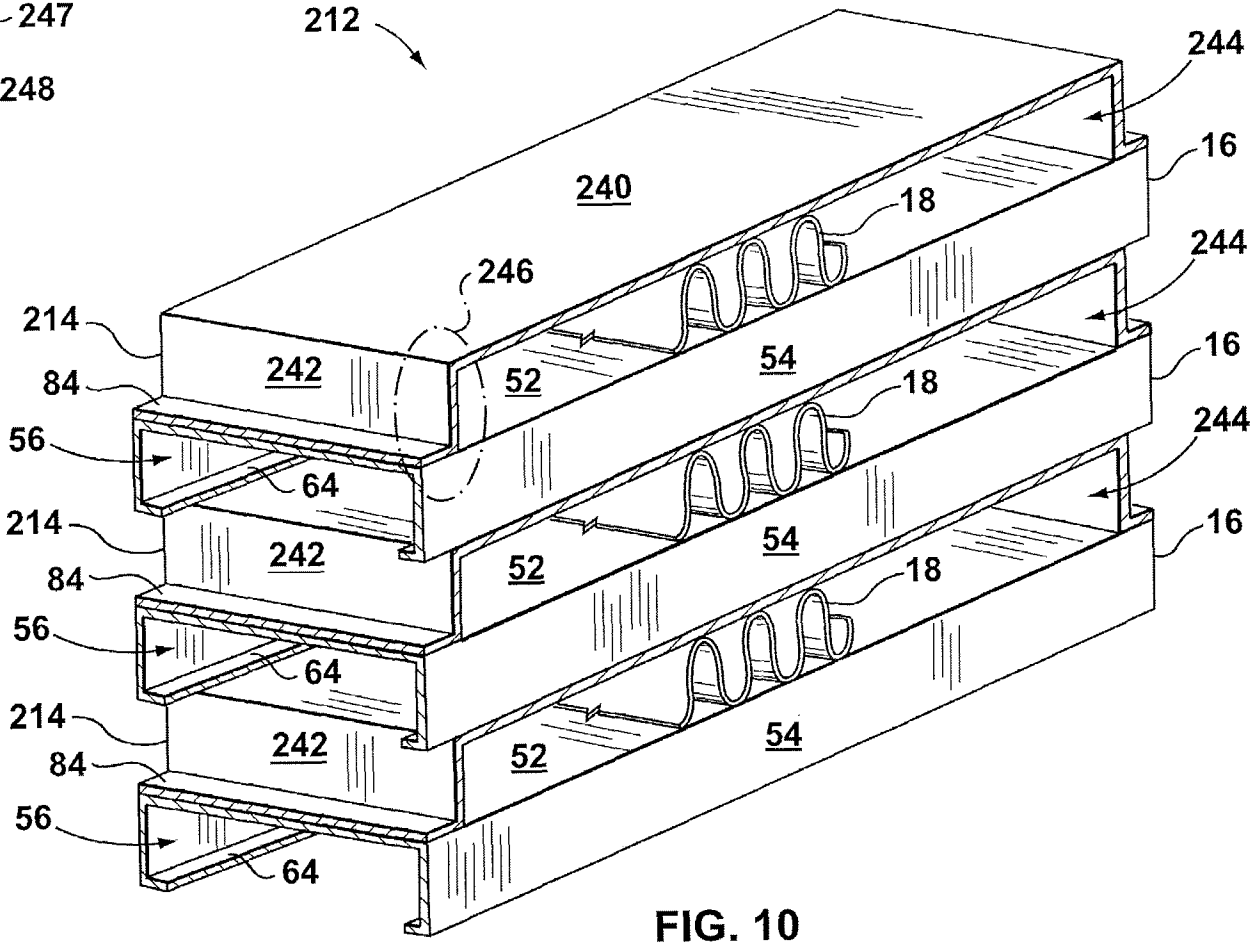
FIG. 10 is a perspective view of a heat exchanger core according to another embodiment of the invention.

FIG. 10 illustrates a further variation of the heat exchanger core 212 shown in FIGS. 2 to 4. Similar reference numerals have been used to identify similar features of the heat exchanger core; however, the reference numerals used to identify the features of the first heat exchange plates have been increased by a factor of two hundred.

Figure 10A:
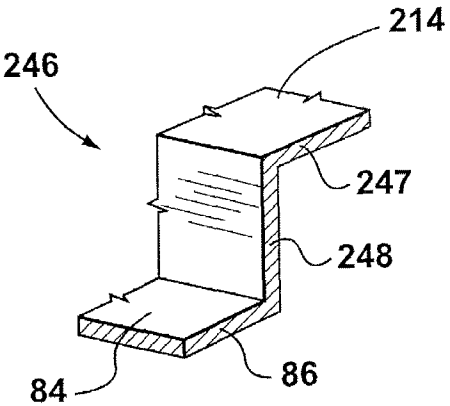
FIG. 10A is a detail view an end portion of the first heat exchanger plates identified by chain-dotted line 246 in FIG. 10.

In the embodiment shown in FIG. 10, heat exchanger core 212 is comprised of an alternating stack of modified first heat exchange plates 214 and the standard second heat exchange plates 16. First heat exchange plates 214 are formed of inverted generally U-shaped bodies having a top wall 240, two downwardly depending closed peripheral side walls 242 and open ends 244. However, in this embodiment the downwardly depending closed peripheral sidewalls 242 terminate with outwardly bent flange portions 84 as opposed to the inwardly bent flange portions 50 shown in FIG. 2. Therefore, in this embodiment, the end portions 246 of first plates 214 include the end edges 247 of a portion of the top wall 240, the end edges 248 of the side walls 242 and the end edges 86 of the outwardly bent flange portions 84 (see FIG. 10A).

Manifold members (not shown) are positioned on the respective ends of heat exchanger core 212 in a similar manner as described in connection with the embodiment shown in FIG. 2. Accordingly, the manifold members create butt joints and lap joints with the respective end portions 246, 58 of the first and second heat exchange plates 214, 16.

Figure 11:
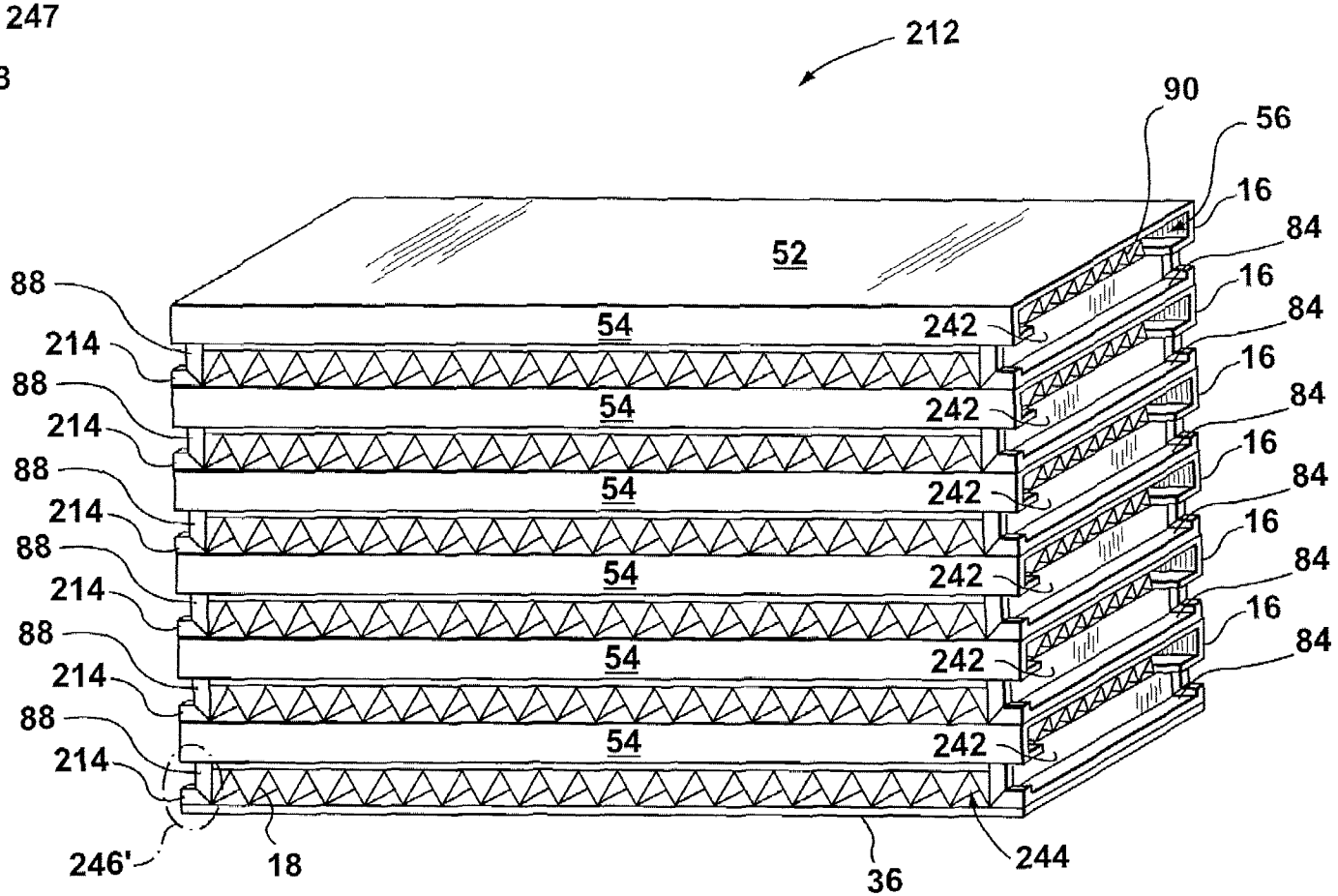
FIG. 11 is a perspective view of a variation of the heat exchanger core shown in FIG. 10.
Figure 11A:
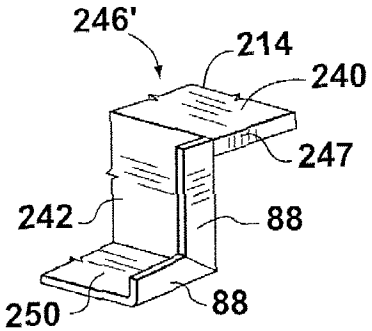
FIG. 11A is a detail view of an end portion of the first heat exchange plates identified by chain dotted line 246' in FIG. 11.

FIG. 11, shows a variation to the heat exchanger core 212 shown in FIG. 10. In this embodiment, first heat exchange plates 214 can be modified so as to include lateral or side flanges 88. Therefore, in this embodiment, the end portions 246' of first plates 214 include the side flanges 88 (see FIG. 11A) and optionally a portion of the end edges 247 of the top wall 240. The addition of side flanges 88 provides additional surface area for joining with the manifold members 20, 22 (not shown) when the heat exchanger components are brazed together.

The heat exchanger core 212 shown in FIG. 11 includes turbulizers 90 in the second set of flow channels created between the open ends 56 of the second heat exchange plates 16. The turbulizers 90 create turbulence in the fluid flowing through the second set of flow channels which increases the rate of heat transfer. While turbulizers 90 have only been shown in the embodiment illustrated in FIG. 11, it will be understood that turbulizers 90 or any other heat transfer augmentation device can be used in any of the embodiments of the present invention.

Figure 12:
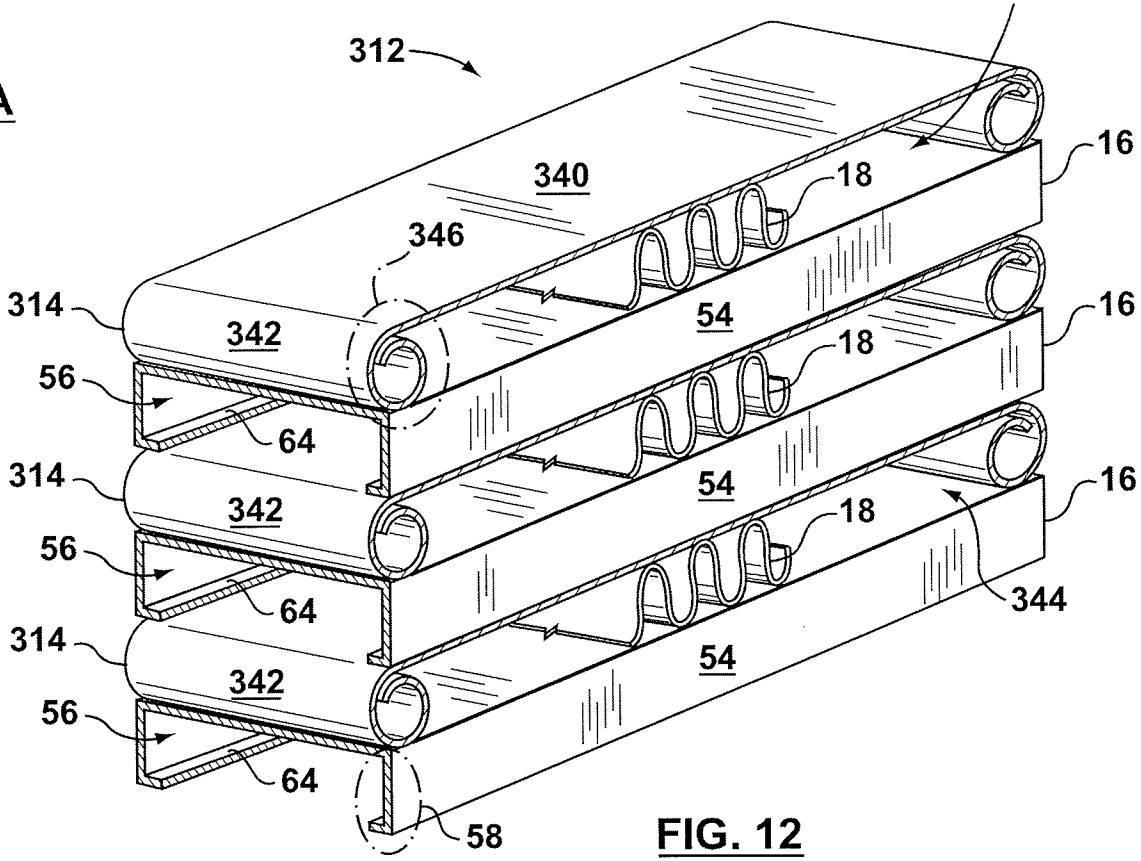
FIG. 12 is a perspective view of a heat exchanger core according to a further embodiment of the present invention.

Referring now to FIG. 12, there is shown yet another embodiment of a heat exchanger core 312 of the present invention. Similar reference numerals have been used to identify similar parts of the heat exchanger core; however, the reference numerals used to identify the features of the first heat exchange plates have been increased by a factor of three hundred.

Figure 12A:
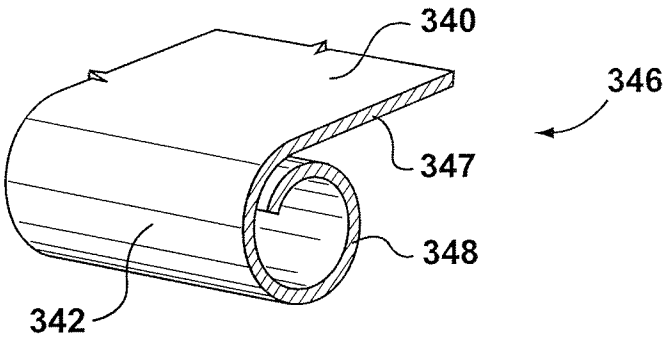
FIG. 12A is a detail view of a end portion of the first heat exchange plates identified by chain dotted line 346 in FIG. 12.

According to the embodiment shown in FIG. 12, the heat exchanger core 312 is comprised of an alternating stack of modified first heat exchange plates 314 and the standard second heat exchange plates 16. First heat exchange plates 314 are formed of inverted generally U-shaped bodies with top wall 340, two downwardly depending closed peripheral side walls 342 and open ends 344. However, in this embodiment, the side walls 342 are shaped so as to have an inwardly spiraling circular profile. Therefore, end portions 346 of first plates 314 include the end edges 347 of a portion of the top wall 340 as well as the end edges 348 of the circular side walls 342 (see FIG. 12A).

Manifold members 20, 22 (not shown) are positioned on the respective ends of the heat exchanger core 312 in a similar manner as described above in connection with the various other embodiments. Therefore, as manifold members 20, 22 are positioned on the core 312, they create both butt joints and lap joints with the respective end portions 346, 58 of the first and second heat exchange plates 314, 16. However, in this embodiment, the inwardly spiraling circular side walls 342 provide almost twice as much surface area for creating the butt joints with the manifold members 20, 22 when the components are joined together. The circular side walls 342 also provide a certain give or spring-like action when assembling the heat exchanger core 312, which assists in the assembly of the device.

While the present invention has been described with reference to certain preferred embodiments, it will be understood by persons skilled in the art that the invention is not limited to these precise embodiments and that variations or modifications can be made without departing from the scope of the invention as described herein. For example, if the subject heat exchangers were used as oil coolers with oil flowing through the manifolds, the height of second heat exchange plates 16, 116 would be larger and turbulizers or other heat transfer augmentation devices such as dimples or ribs formed in the top wall of the plates probably would be used inside second heat exchange plates 16, 116. In other applications, the height of the second heat exchange plates 16, 116 may be much smaller and turbulizers or other heat transfer augmentation devices may or may not be used. Accordingly, it will be appreciated that the heat exchanger disclosed in the present application can be adapted to suit various applications.

What is claimed is:

1. A heat exchanger selected from the group of vehicular heat exchangers consisting of exhaust gas cooler and charge air cooler, the heat exchanger comprising:

a plurality of stacked, alternating first and second heat exchange plates of inverted U-shaped cross-section, said first and second plates having closed peripheral side walls and open ends;

the open ends of said first plates being oriented at 90° to the open ends of said second plates;

the sidewalls of said first and second plates having end portions, the end portions in adjacent first and second plates being aligned to form corners of the heat exchanger;

opposed U-shaped bodies having open ends and lateral walls joined in a liquid tight manner to the aligned first and second plate sidewall end portions;

end plates closing the open ends of said U-shaped bodies to form manifolds for the flow of liquid through the plate open ends of said second plates; and said manifolds defining inlet and outlet openings for the flow of liquid into and out of the heat exchanger.

2. A heat exchanger as claimed in claim 1, wherein the end portions of said first plates are the end edges of said closed peripheral side walls.

3. A heat exchanger as claimed in claim 1, wherein the end portions of said second plates are planar surfaces adjacent to the end edges of said closed peripheral side walls.

4. A heat exchanger as claimed in claim 1, wherein the closed peripheral side walls of said first plates are shaped to minimize entrance pressure losses at the open ends of said second plates.

5. A heat exchanger as claimed in claim 4, wherein the closed peripheral side walls of said first plates have a triangular profile.

6. A heat exchanger as claimed in claim 1, wherein the closed peripheral side walls of said first plates include an offset portion for abutting with the open end of the adjacent second plate so as to be self-fixturing.

7. A heat exchanger as claimed in claim 1, wherein the thickness of the sidewalls of said first plates is twice the thickness of the sidewalls of said second plates.

8. A heat exchanger as claimed in claim 1, wherein said first and second heat exchange plates each have a length corresponding to the distance between the open ends thereof, and a width corresponding to the distance between the closed peripheral side walls, the length of said first plates being greater than the width of said second plates and the length of said second plates being greater than the width of said first plates.

9. A heat exchanger as claimed in claim 8, wherein:

the end portions of said first plates are planar surfaces adjacent the end edges of the closed peripheral sidewalls, said end portions overhanging the closed peripheral sidewalls of the adjacent second plates by a distance corresponding to the difference between the length of said first plates and the width of said second plates; and the end portions of said second plates are planar surfaces adjacent the end edges of said closed peripheral side walls, said end portions overhanging the closed peripheral side walls of the adjacent first plates by a distance corresponding to the difference between the length of said second plates and the width of said first plates.

10. A heat exchanger as claimed in claim 9, wherein the end portions of said first and second plates form substantially 90° recessed corners of the heat exchanger for receiving said U-shaped bodies.

11. A heat exchanger as claimed in claim 1, wherein the lateral walls of said U-shaped bodies have peripheral end portions for mating with said heat exchanger corners.

12. A heat exchanger as claimed in claim 11, wherein said peripheral end portions are planar inner end surfaces on the inside of said lateral walls.

13. A heat exchanger as claimed in claim 11, wherein each of said peripheral end portions comprise a planar inner end surface on the inside of said lateral wall and a flange projecting outwardly from the end of said lateral wall perpendicular thereto.

14. A heat exchanger as claimed in claim 11, wherein said peripheral end portions are inwardly bent portions formed at each end of said lateral walls, said inwardly bent portions having a first end surface perpendicular to said lateral wall and a second end surface parallel to said lateral wall and spaced apart therefrom a distance corresponding to the length of said first end surface.

15. A heat exchanger as claimed in claim 1, further including cooling fins located between the first heat exchange plates and the adjacent second heat exchange plates.

16. A heat exchanger as claimed in claim 1, wherein the closed peripheral side walls of said first plates have an inwardly bent flange portion for resting on the adjacent second heat exchange plate.

17. A heat exchanger as claimed in claim 1, wherein the closed peripheral side walls of said first heat exchange plates have an outwardly bent flange portion for resting on the adjacent second heat exchange plate.

18. A heat exchanger as claimed in claim 1, wherein the closed peripheral side walls of said first heat exchange plates have an inwardly spiraling circular profile.

19. A heat exchanger as claimed in claim 17, further including side flanges projecting laterally from said closed peripheral side walls and said outwardly bent flange portion, the end portions of said first heat exchange plates comprising said side flanges.

20. A heat exchanger as claimed in claim 1, further including turbulizers located between the second heat exchange plates and the adjacent first heat exchange plates.

* * * * *

UNITED STATES PATENT AND TRADEMARK OFFICE

CERTIFICATE OF CORRECTION

PATENT NO. : 8,646,516 B2
APPLICATION NO. : 11/465207
DATED : February 11, 2014
INVENTOR(S) : Abels et al.

It is certified that error appears in the above-identified patent and that said Letters Patent is hereby corrected as shown below:

Title Page

Item (73) Assignee: Should read -- Dana Canada Corporation, Oakville, Ontario (CA) --.

Signed and Sealed this
Twenty-first Day of October, 2014

Michelle K. Lee

Michelle K. Lee
*Deputy Director of the United States Patent and Trademark Office*